US007514884B2

(12) United States Patent
Potucek et al.

(10) Patent No.: US 7,514,884 B2
(45) Date of Patent: Apr. 7, 2009

(54) MICROPROCESSOR CONTROLLED TIME DOMAIN SWITCHING OF COLOR-CHANGING LIGHTS

(75) Inventors: Kevin L. Potucek, Far Hills, NJ (US); Kevin Murphy, Quartz Hill, CA (US)

(73) Assignee: Pentair Water Pool and Spa, Inc., Sanford, NC (US)

( * ) Notice: Subject to any disclaimer, the term of this patent is extended or adjusted under 35 U.S.C. 154(b) by 360 days.

(21) Appl. No.: 10/974,208

(22) Filed: Oct. 27, 2004

(65) Prior Publication Data

US 2005/0088119 A1 Apr. 28, 2005

Related U.S. Application Data

(60) Provisional application No. 60/515,162, filed on Oct. 28, 2003.

(51) Int. Cl.
*H05B 37/00* (2006.01)

(52) U.S. Cl. ..... 315/322; 315/323; 315/362

(58) Field of Classification Search ..... 315/291, 315/312, 313, 314, 322, 323, 362; 362/101, 362/800, 227

See application file for complete search history.

(56) References Cited

U.S. PATENT DOCUMENTS

| | | | | |
|---|---|---|---|---|
| 5,051,875 | A | 9/1991 | Johnson | |
| 5,842,771 | A | 12/1998 | Thrasher et al. | |
| 6,002,216 | A | 12/1999 | Mateescu | |
| 6,118,230 | A | 9/2000 | Fleischmann | |
| 6,174,067 | B1 | 1/2001 | Thrasher et al. | |
| 6,241,361 | B1 | 6/2001 | Thrasher et al. | |
| 6,379,025 | B1 | 4/2002 | Mateescu et al. | |
| 6,616,291 | B1 * | 9/2003 | Love | 362/101 |
| 2002/0130627 | A1 | 9/2002 | Morgan et al. | |
| 2002/0153851 | A1 | 10/2002 | Morgan et al. | |
| 2002/0163316 | A1 | 11/2002 | Lys et al. | |
| 2002/0171377 | A1 | 11/2002 | Mueller et al. | |
| 2002/0171378 | A1 | 11/2002 | Morgan et al. | |
| 2003/0156422 | A1 * | 8/2003 | Tatewaki et al. | 362/487 |
| 2004/0212993 | A1 | 10/2004 | Morgan et al. | |
| 2005/0063123 | A1 * | 3/2005 | Cline et al. | 361/104 |

FOREIGN PATENT DOCUMENTS

| | | | |
|---|---|---|---|
| EP | 0 752 632 | A2 | 1/1997 |
| WO | WO 02/061330 | A2 | 8/2002 |
| WO | WO 02/091805 | A2 | 11/2002 |
| WO | WO 02/098183 | A1 | 12/2002 |

* cited by examiner

*Primary Examiner*—David Hung Vu
(74) *Attorney, Agent, or Firm*—Greenberg Traurig, LLP

(57) ABSTRACT

A lighting system controller comprising a switch connected to a lighting fixture configured to be controlled by time domain switching, and a processor capable of actuating said switch so as to achieve time domain switching of the lighting fixture.

10 Claims, 5 Drawing Sheets

SINGLE BUTTON COLOR SYNCHRONIZATION

SINGLE BUTTON COLOR-CHANGE SEQUENCING (SWIMMING COLORS)

USER INTERFACE SCREEN HEIRARCHY FOR MICRO-PROCESSOR CONTROLLED TIME DOMAIN SWITCHING SYSTEM FOR CONTROL OF POOL AND SPA LIGHTING FIXTURES AND AUXILIARY EQUIPMENT

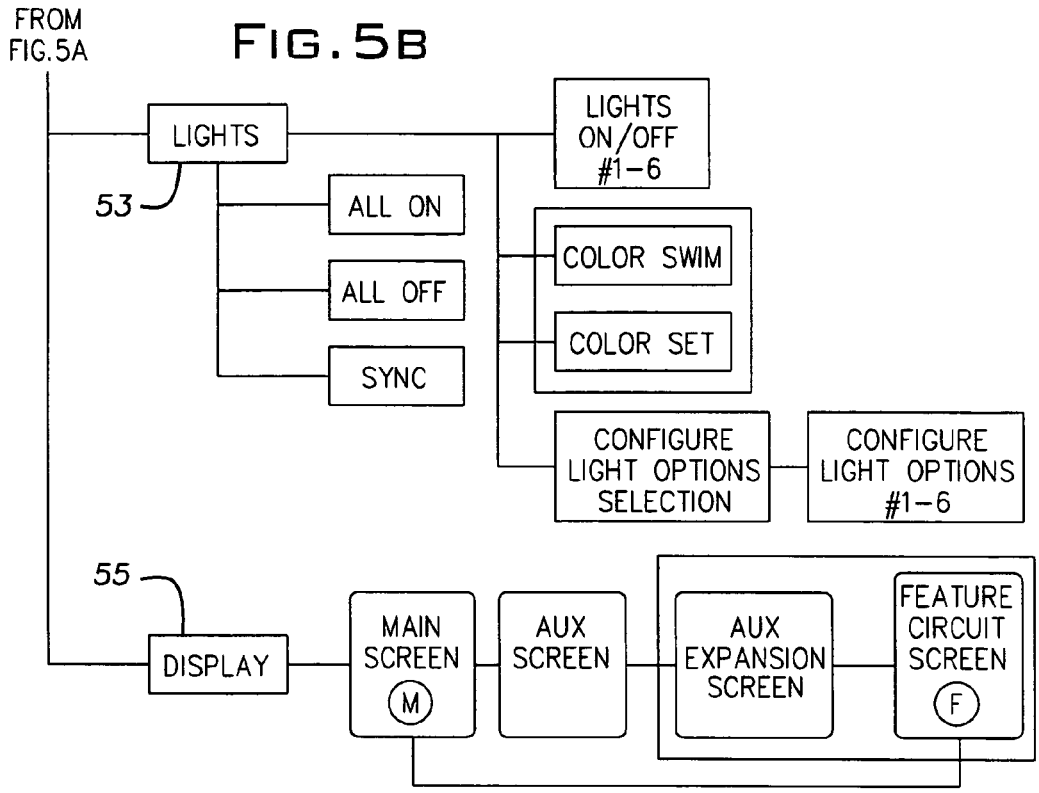
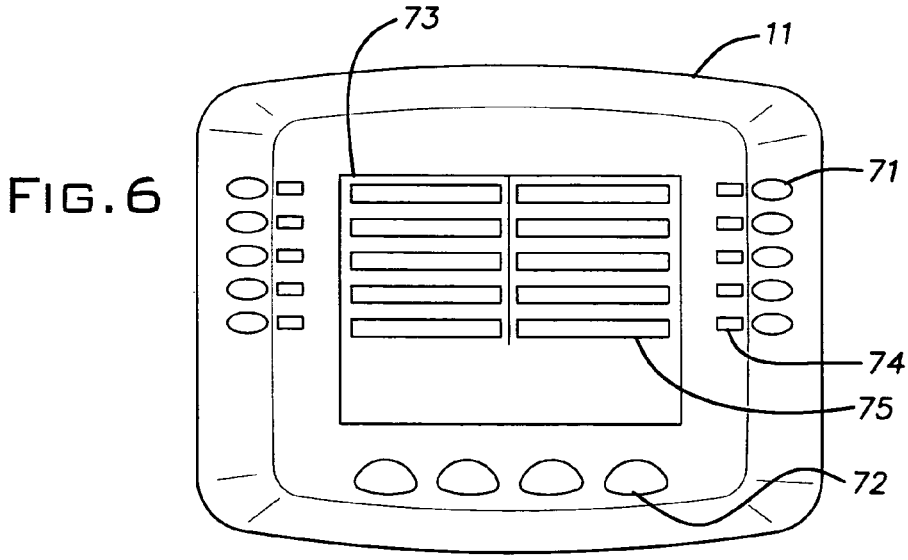
USER INTERFACE UNIT FOR MICRO-PROCESSOR CONTROLLED TIME DOMAIN SWITCHING SYSTEM FOR CONTROL OF POOL AND SPA LIGHTING FIXTURES AND AUXILIARY EQUIPMENT

MICROPROCESSOR CONTROLLED TIME DOMAIN SWITCHING OF COLOR-CHANGING LIGHTS

STATEMENT OF RELATED APPLICATIONS

This application claims the benefit of provisional patent application Ser. No. 60/515,162, incorporated herein by reference.

FIELD OF THE INVENTION

This application relates generally to an apparatus and method for controlling lighting effects.

More specifically, this application relates to an apparatus and method for computer control of pool/spa lighting effects and computer control of various other pool or spa equipment.

BACKGROUND OF THE INVENTION

Color-changing lights and lighting effects have become very popular in swimming pools and spas. For installations that use multiple color-changing lights, the user typically prefers that colors of the separate lights change in color synchronization. If the color changing of the separate lights is done in a particular sequence, it can be made to appear that the light color is "moving" from one end of the pool to the other. Users also often desire to stop the separate lights on different colors to create a color combination to achieve a unique effect or to define a holiday, e.g., red and green for Christmas, red, white and blue for the Fourth of July, etc.

For some color changing lights, color control can be achieved by manually interrupting power to the light's internal microprocessor which activates the color changing mechanism. If the user wants individual control of multiple lights for basic illumination or for color lighting effects, this could require separate, manually activated switches, complicating the design and control. If all lights are desired to be color synchronized, this might require all of the manual switches to be operated simultaneously, which is difficult at best.

Another option is to utilize a complex, costly, manually operated combination of manual switches that could allow for a single toggle switch control. If it is desired to have the lights change color in sequence to give the appearance of colors chasing or movement from one end of the pool to the other, that could require the switches to be turned off and on manually in the desired sequence with the desired delay, which would be difficult to accomplish.

Lighting controllers for color-changing lighting often use a fourth wire (power, neutral, ground, control) to change color. Fourth wire control requires additional switching, for example control relays, and additional wiring.

Pool/Spa controllers have historically limited the number of features or pieces of equipment they control. The higher the number of circuits for equipment control, the higher the cost and the higher the selling price. Each piece or group of controlled electrical equipment typically requires its own line voltage relay. Thus, the number of circuits controlling line voltage relays became a key factor in cost and in competitive product comparison and differentiation. Feature circuits that can control valve actuators for water features, without using a line voltage relay circuit, allow the control of additional features without the cost or space required of line voltage relays. In many cases, the use of a product feature requires that a relay output circuit be wasted. It would be beneficial to have feature circuits that allow advanced functions without wasting these valuable relay outputs.

In addition, it would be useful to have a control system that can be used with various pool/spa lighting schemes and solutions. For example, U.S. Pat. No. 6,379,025 discloses a submersible lighting fixture with color wheel. U.S. Pat. No. 5,051,875 discloses an Underwater pool light. U.S. Pat. No. 6,241,361 discloses a Submersible light fixture. U.S. Pat. No. 6,174,067 discloses a Lighting system, apparatus and method. U.S. Pat. No. 6,002,216 discloses a Pool lighting system, illuminator, and method. And U.S. Pat. No. 5,842,771 discloses a Submersible light fixture. All of the above references, hereby incorporated by reference, could utilize a computerized control system.

A means of controlling various commercially available automated pool/spa lighting products would also be useful. For example, it would be useful to control the commercially available SAm® light, also known as the SPECTRUM AMERLITE™, which is an underwater light that changes color at the flip of a switch. SAm® features electronic circuitry that allows a user to control the color of the light emitted by its twin halogen quartz bulbs.

Delivering a nearly limitless spectrum of color, SAm® can bathe a pool in a custom color a user selects to suit the user's mood, or slowly roll through the entire spectrum in a luminous underwater display. And, for pools with more than one light, multiple SAm® lights synchronized with one another could be used to provide uniformly spectacular color from one end of the pool to the other. A means for integrating and/or automating the control of SAm® lights would be useful.

SPECTRUM AQUALITE™ (SAL®), a compact version of the SAm® light, is also commercially available. Further, commercial fiber optics pool/spa lighting solutions exist (such as the FIBERWORKS® products) that could also utilize an automated control system. Thus, a system that could be integrated with such commercially available products would be beneficial.

In addition, a lighting controller that can integrate the control of various other pool or spa related equipment, such as pumps, solar heaters, powered heaters, filters, etc. would also be useful.

Desired is a way to control colored lights and other pool/spa equipment in a simple, but entertaining manner.

SUMMARY OF THE INVENTION

Provided is a lighting system controller comprising a switch connected to a lighting fixture configured to be controlled by time domain switching, and a processor capable of actuating the switch so as to achieve time domain switching of the lighting fixture.

Further provided is a lighting system controller comprising a first switch connected to a first load, a second switch connected to a second load, and a processor capable of independently controlling the first switch and the second switch in a manner capable of providing time domain switching of one or both of the first load and the second load.

Further provided is a method of creating dynamic color displays comprising the steps of providing a first lighting fixture configured to be controlled by time domain switching, providing a second lighting fixture configured to be controlled by time domain switching, signaling one of the first lighting fixture and the second lighting fixture to begin color changing, signaling the other one of the first lighting fixture and the second lighting fixture to begin color changing after a time delay has elapsed.

Further provided is a lighting system controller comprising a first switch connected to a first lighting fixture configured to be controlled by time domain switching, a second switch connected to a second lighting fixture configured to be controlled by time domain switching, and a processor capable of independently controlling the first switch and the second switch for providing time domain switching to both the first lighting fixture and the second lighting fixture, wherein the controller is configured for first signaling the first lighting fixture to begin color changing and the controller is also configured for second signaling the second lighting fixture to begin color changing after a time delay has elapsed after the first signaling.

Further provided is a lighting system controller comprising a first switch connected to a first lighting fixture configured to be controlled by time domain switching, a second switch connected to a second lighting fixture configured to be controlled by time domain switching, an output switch for switching power to a device that is not a lighting fixture, and a processor capable of controlling the first switch and the second switch for providing time domain switching to both the first lighting fixture and the second lighting fixture, wherein the controller is configured for first signaling the first lighting fixture to begin color changing and the controller is also configured for second signaling the second lighting fixture to begin color changing after an adjustable time delay has elapsed after the first signaling, and wherein the processor is capable of actuating the plurality of output switches.

BRIEF DESCRIPTION OF THE DRAWINGS

FIGS. 5A and 5B together are a hierarchy of user interface screens for the control and setup of a preferred embodiment of the method and apparatus; and FIG. 6 shows a user interface unit for the control and setup of a preferred embodiment of the method and apparatus.

DETAILED DESCRIPTION OF THE PREFERRED EMBODIMENTS

Provided is a computerized, programmable, electronic and/or electro-mechanical device used for controlling lighting systems and optionally also for controlling any combination of pool and spa equipment (such as pumps, filters, heaters, cleaners, and other lights, for example) including color changing lighting.

In the preferred embodiment, this is accomplished by providing a microprocessor controlled system that is external to color-changing lighting and which is configured to perform power line control and time-domain switching of color-changing lighting. Additionally, the system can support other control protocols, for example fourth wire control.

Figure 1:
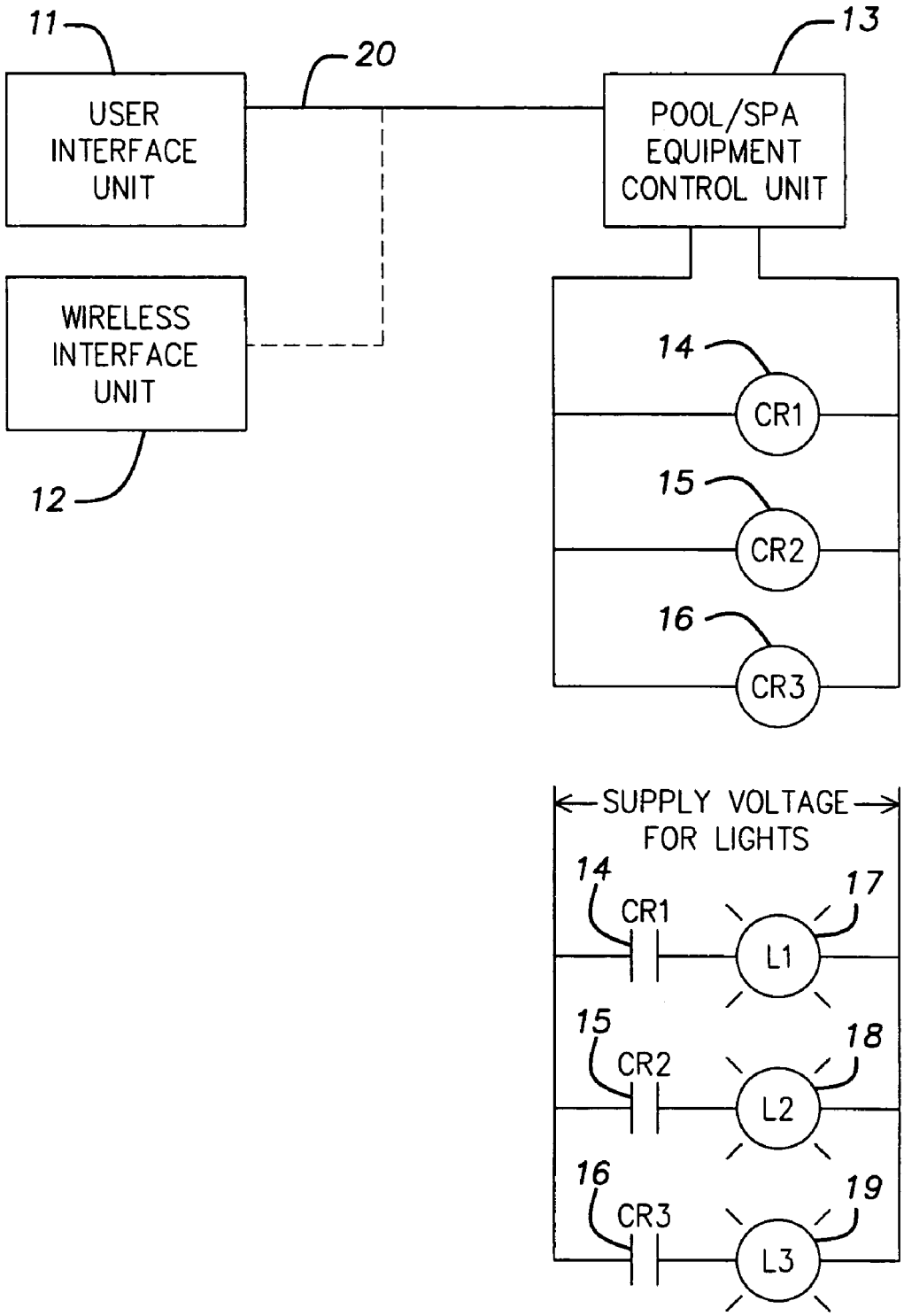
FIG. 1 is a partial control diagram for a microprocessor controlled time domain switching system of a preferred embodiment for control of pool and spa lighting fixtures and other controlled devices.

FIG. 1 shows a partial control diagram for a processor controlled time-domain switching system for control of pool and spa lighting fixtures. A system user may program and control the system from either the user interface unit 11 or an optional wireless interface unit 12. For example, the user may initiate color synchronization or program the desired color of pool lighting fixtures from the user interface unit 11. The user interface unit 11 signals the pool/spa equipment control unit 13 to begin a desired control operation, for example color synchronization of pool lighting fixtures, by communications over a communications link 20. The pool/spa equipment control unit 13, which can utilize a microprocessor or programmable controller, for example, activates switches 14, 15, 16 according to a programmed control scheme in order to control connected equipment, for example lighting fixtures configured to be controlled by time domain switching 17, 18, 19. The connected equipment could also be comprised of controlled devices not configured to be controlled by time domain switching, for example a pump, heater, filter, or valve actuator, for example.

The following features, once programmed by the installer or user, allow simple control of otherwise complex lighting features. This can be achieved using existing "power-interruption" or time-domain switching control protocols of the lighting systems (e.g., the SAm® light), as known in the art, which does not require a dedicated "control wire" to the light. Instead, power line control is utilized, rather than using a fourth control line. Power line color-control is useful for SAm® and other lighting solutions for allowing simple control as a stand-alone product. However, a fourth control line control could also be supported.

Figure 2:
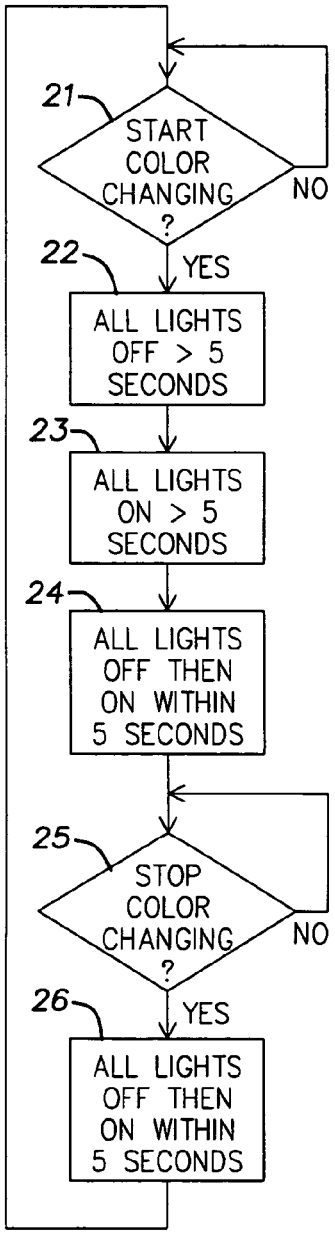
FIG. 2 is a flow chart for an example method of single button color synchronization of lighting fixtures configured to be controlled by time domain switching.

As can be seen in the example control process of FIG. 2, single button (dedicated or assignable button) color-synchronization with one button touch can be utilized to:

1) start color changing when the button is activated 21; then
2) turn controlled lights off for more than 5 seconds to erase a separate temporary memory of color lights 22; then
3) turn all controlled lights "on" for more than 5 seconds 23; then
4) turn all lights off then on again within 5 seconds to activate color-changing of all controlled lights in color synchronization 24; and then
5) stop color changing when the button is activated 25 by turning all lights off then on again within 5 seconds to de-activate color changing of all controlled lights 26.

Figure 3:
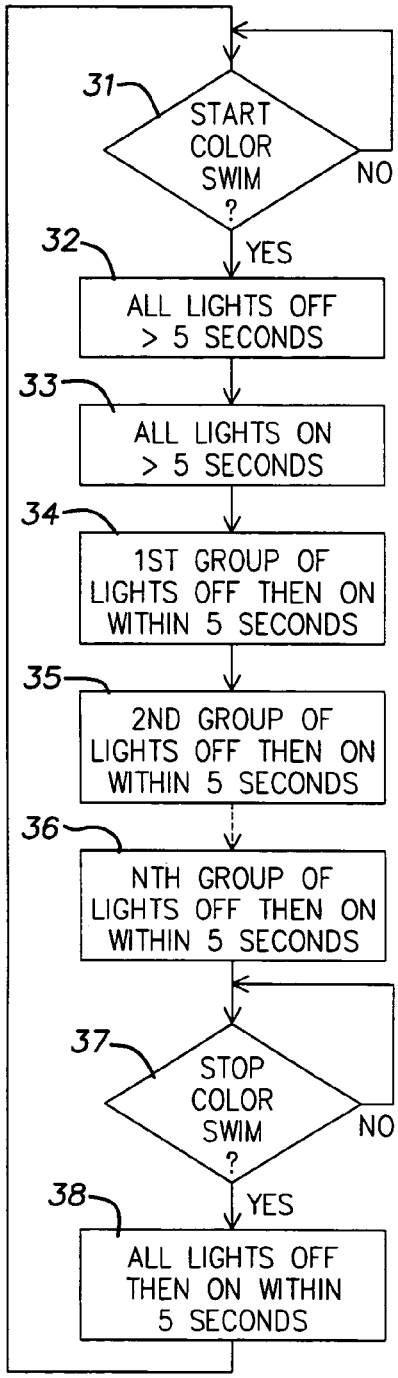
FIG. 3 is a flow chart for an example method of single button color-change sequencing (swimming colors) of lighting fixtures configured to be controlled by time domain switching.

As can be seen in the example control process of FIG. 3, single button (dedicated or assignable) color-change sequencing (swimming colors) with one button touch is provided to:

1) start color swimming when the button is activated 31; then
2) turn controlled lights off for more than 5 seconds to erase a separate temporary memory of color lights 32; then
3) turn all controlled lights "on" for more than 5 seconds 33; then
4) turn individual or selected station of lights off and then on again within 5 seconds to activate color-changing of first station lights 34; then
5) turn individual or selected station of lights off and then on again within 5 seconds to activate color-changing of second station lights 35; then
6) turn individual or selected station of lights off and then on again within 5 seconds to activate color-changing of third station lights, etc, thus achieving the color-chasing or swimming color effect 36; and then 7) stop color swimming when the button is activated 37 by turning all lights off then on again within 5 seconds to de-activate color changing of all controlled lights 38.

Figure 4:
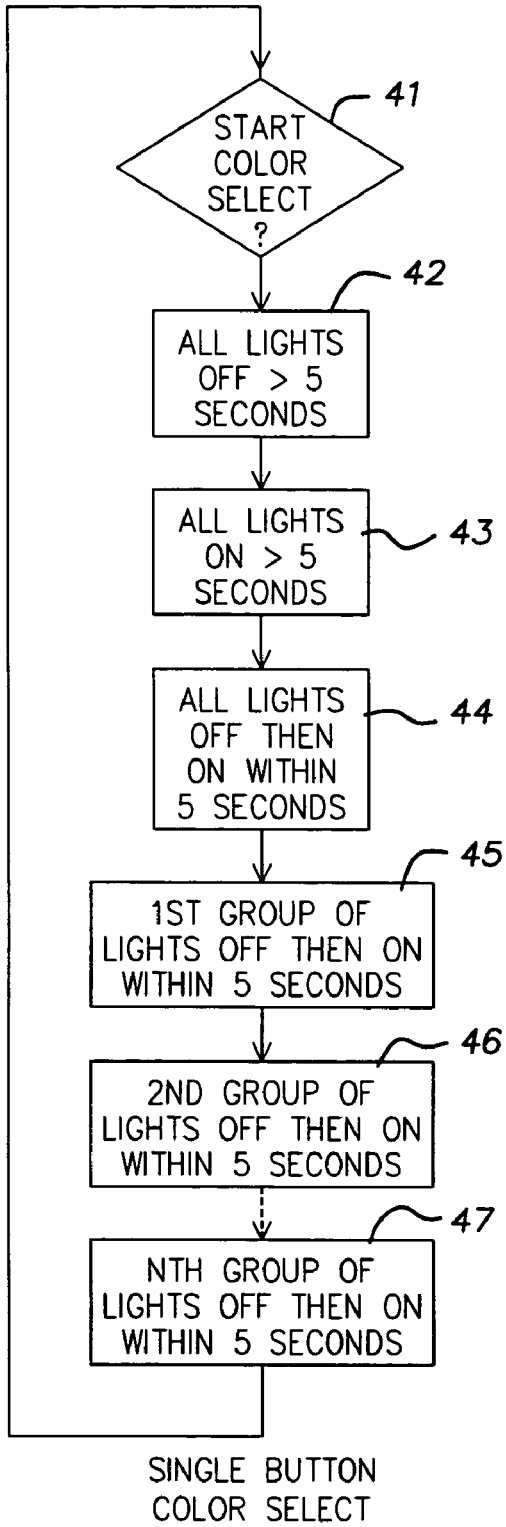
FIG. 4 is a flow chart for an example method of single button color selection of lighting fixtures configured to be controlled by time domain switching.

As can be seen in the example control process of FIG. 4, provided is also a color select feature, wherein specific colors or color combinations can be programmed, assigning specific colors to specific lights or stations of lights. After programming, a single touch of a button can set lights to pre-programmed color combinations by:

1) start color select when the button is activated 41; then
2) turn controlled lights off for more than 5 seconds to erase a separate temporary memory of color lights 42; then
3) turn all controlled lights "on" for more than 5 seconds 43; then
4) turn all controlled lights off and then on again within 5 seconds to activate color-changing 44; then
5) after a specific time delay which corresponds to a specified color, turn individual or a selected station of lights off and then on again within 5 seconds to stop color-change at a pre-programmed color 45; and then
6) turn other individual lights or light stations off/on at the appropriate time to stop the color-change for the light or station of lights at pre-selected color synchronization 46, 47.

Further provided in a preferred embodiment is a programmable, electronic or electromechanical device and method for controlling lighting systems alone or for controlling any combination of pool and spa equipment (pump, filter, heater, cleaner) including color changing lights. It is also capable of switching circuits (feature circuits) without line-voltage relay dependency. Feature circuits include control of low-power, low-voltage valve actuators for changing flow supply to water features such as waterfalls and fountains. Feature circuits can also be used to control the high-speed of a two-speed pump. Support for switching circuits (feature circuits) without line-voltage relay dependency is also included, as well as microprocessor controlled switching and automation of in-home low voltage features.

An external controller with processor control (using a microprocessor or programmable controller, for example) operates in coordination with color-changing lights using internal microprocessor control. The external controller can utilize time domain switching (timed power-interruption) to control color changing lights. An example of time domain switching can be found in U.S. Pat. No. 6,379,025, incorporated by reference, which discloses an embodiment wherein timed power interruption controls the operation of color changing lights according to the light's power-interruption protocol.

Color-change sequencing (swimming colors) is provided in a preferred embodiment using microprocessor power line control and time domain switching. An external controller is set up to use the light's power-interruption protocol, for example the time domain switching as described in U.S. Pat. No. 6,379,025, to activate color-changing in multiple lights in synchronization or in timed sequence for special effects.

A synchronization circuit can be provided in a light fixture to be controlled by time domain switching according to a preferred embodiment, as discussed hereinbelow. The circuit operates in a way that allows multiple lighting fixtures to be synchronized without the need for additional wiring between units.

The synchronization circuit uses the power supply, typically a 60 Hz alternating current supply voltage, to generate a master pulse. Thus, the same master pulse is generated for every lighting fixture that is connected to the same power source. Accordingly, there are no slave units and no need for wiring from a master unit to slave unit in order to transmit the master reference signal to each slave unit.

The synchronization circuits described above utilize time domain switching, and thus are controlled by timed interruptions in the supply voltage. Each power interruption is used as a reference point by the synchronization circuits allowing all of the color wheels on the lighting fixtures to be synchronized and the same accent color from each of the lighting fixtures to be provided to the pool water.

The synchronization circuit of each lighting fixture synchronizes the color wheel by controlling a driver mechanism to place the color wheel at a predetermined position subsequent to the source of power being interrupted in a predetermined sequence. Thus, time domain switching is used to assure that the color wheels are synchronized.

After a predetermined time, the synchronization circuits begin stepping the motors that rotate the color wheel. If the power to the light fixtures is applied at the same instant, then each color wheel will begin stepping at about the same time and the wheels will step at the same rate, typically being determined by the sine waves of an alternating-current source of power. Thus, the color wheels remain synchronized.

Further, time domain switching provides for dynamic color effects, for example color swimming effects, that can be achieved by independently switching individual or selected stations of lights that are capable of being controlled by time domain switching in a time-shifted fashion. For example, color changing can be initiated in a first light at time $t_0$ by first switching its power off, and then on again within 5 seconds. Subsequently, at time $t_0+\Delta t$, color changing can be initiated in a second light by switching its power off then on again within about 5 seconds. By switching the two lights at slightly different times, each light will synchronize its color changing (to the 60 Hz power line, for example), however one will lag the other in time by the time delay $\Delta t$. Accordingly, dynamic color effects or displays can be achieved by forcing (using the controller) multiple lights or stations of lights to change colors at the same rate, but at slightly different times. For example, colored light can be made to seemingly swim through the water. The speed at which the colors swim through the water can be adjusted by changing the time delay $\Delta t$. For example, by decreasing the time delay $\Delta t$, colors can be made to seem to swim more quickly through the water. Conversely, by increasing the time delay $\Delta t$, colors can be made to appear to swim more slowly.

Single button/switch color-change sequencing is also provided. Color select with microprocessor power interruption control and time domain switching is implemented via power line control (power line control is broader, including any control—such as X10—that would utilize the power line, for example Powerhouse X-10, along with single button/switching for "color-select").

Single switch color synchronization and single button control or assignable button control of any of above features can be provided, as well as wireless remote control, which may be rechargeable, for example.

Lighting control using precision profiling of one or multiple lighting fixtures, for example fiber color wheel or SAm® profiles, and dedicated fourth direct control wire can also be provided. Combination fourth wire control and power interruption support may also be provided.

General controller features adapted to IntelliTouch™ systems, of which the system described herein is a part, can be added in combination with any of above.

Soft configurations utilizing non-volatile memory are provided (typically no dip-switches are needed), allowing mirroring and transfer from one sub-system to another, for example indoor to outdoor and vice versa.

Circuit function logic can be supported, for example: cleaner, freeze protection, pump delay functions. Automatic mirrored configuration can also be supported in some embodiments.

A universal outdoor circuit board for all models, universal indoor circuit board for all models, universal circuit board for indoor control panel and wireless remote controller can also be utilized.

The system can support default and/or user configurable run-time limits and/or single use of above "once only".

Feature circuits (non-relay driven) circuit control with fully functional programmable circuit (for example actuator, two-speed) can also be provided.

The apparatus can be conveniently located in a weather-protected location (such as in the home) in the Indoor Control Panel, for example. This is typically the primary means of controlling the IntelliTouch system. It consists of an easy-to-read LCD display, 10 status LED's, 10 side buttons, and 5 lower buttons.

Located near the pool or spa may be a spa-side controller, which may be a wireless remote controller. This device could be one or more of the following:

A four button model having and a single LED lamp; and/or

A five buttons model with a top-row/bottom-row toggle button, status LED's, temperature display and adjustment.

Near the pump, filter, and other equipment can be located the Load Center. This is typically where high voltage is distributed to the various pool equipment. This is also typically where the Indoor Control Panel interfaces with the other equipment.

Mounted atop the valves may also be motorized valve actuators used to change the flow of water through the plumbing. There may also be temperature sensors and cabling to the heater.

The apparatus is a smart system that integrates pool and spa control. It has intelligent electronic circuitry and simple programmability. The apparatus makes operating and maintaining the pool or spa incredibly easy. With the apparatus in control, the pool or spa can operate with peak efficiency and economy automatically.

The following description of the figures describes the preferred embodiment of the invention. In particular, programming functions provided to the user for integrating various pool/spa equipment are discussed.

FIGS. 1 through 4 are described in detail above. FIG. 1 is a partial control diagram for a processor controlled time-domain switching system for control of pool and spa lighting fixtures. FIG. 2 is a flow chart for one implementation of single button control of color synchronization. FIG. 3 is a flow chart for one implementation of single button control of color-change sequencing. FIG. 4 is a flow chart for one implementation of single button control of color selection.

Figure 5A:
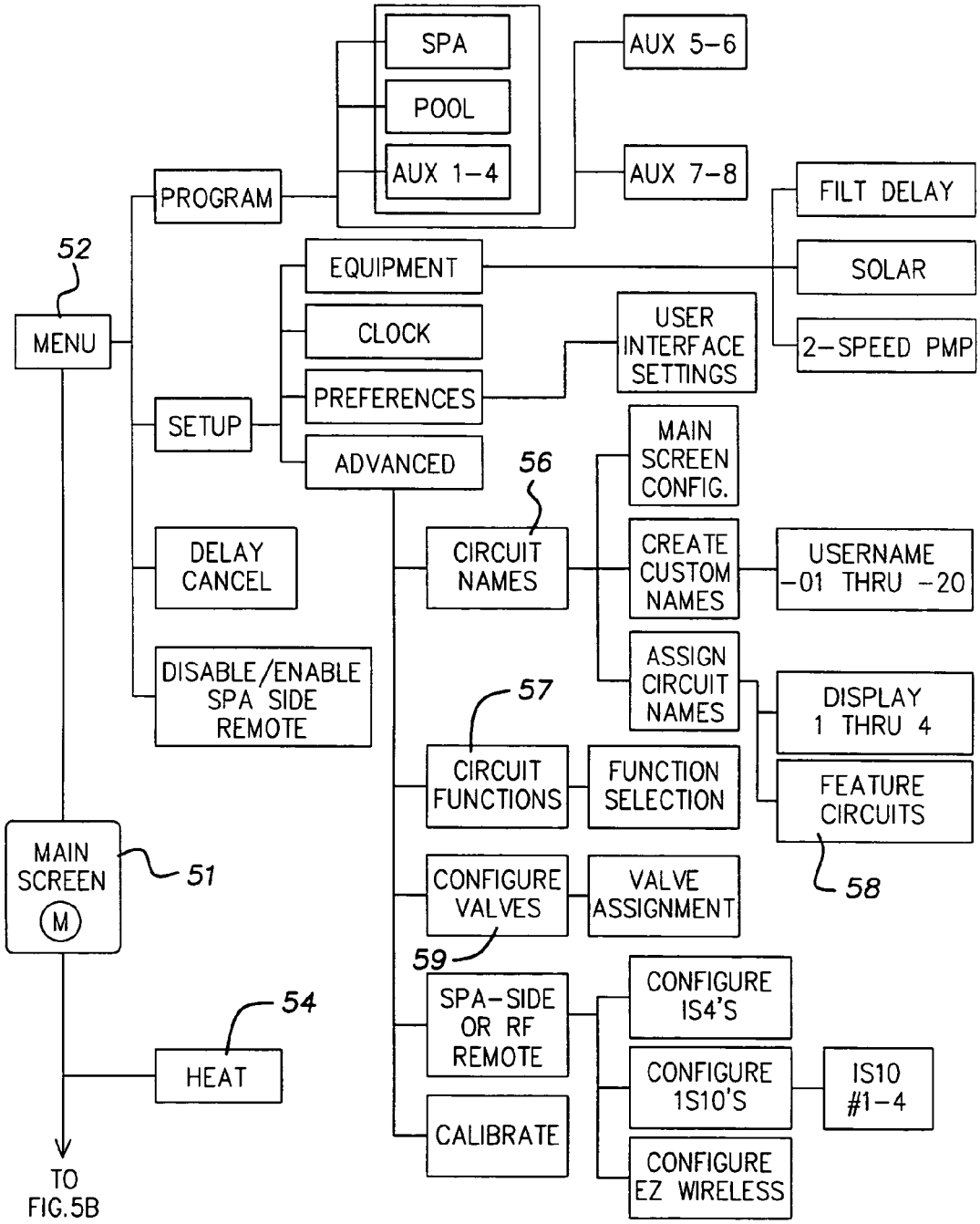

FIGS. 5A and 5B show a hierarchy of user interface screens for the control and setup of a preferred embodiment of the method and apparatus. The main screen 51 provides system information and access to additional screens, for example the lights screen 53. The most commonly used functions should be displayed on the main screen 51, for example equipment running/stopped status and pool or spa temperatures.

As can be seen in FIG. 6, the user interface unit 11 preferably contains pushbuttons 71, 72 and a currently displayed screen 73 on an LCD panel. Navigation among the various screens and control of lights and other controlled devices can be achieved through the use of the pushbuttons 71, 72. The currently displayed screen 73 can be changed as the hierarchy of screens is navigated. For example, from the main screen 51, a user could select a menu screen 52, a heat screen 54, the lights screen 53, or a display screen 55 through use of the pushbuttons 71, 72.

Through software, the user interface unit 11, and user programming, a variety of custom settings could be created, including the assignment of circuit names, control of pumps and other pool and spa equipment, and the control of lighting circuits. For example, a circuit names screen 56 can be provided for user setting of circuit names. There can be 100 or more circuit names stored in the apparatus for ease of use. Further, users can be provided the ability to create additional custom names (20 or more, for example) for custom applications.

Screen selections 75 that may be turned on or off can be used to indicate their status by the adjacent LED 74 turning on or off. To activate, simply press the button to the left or right of the selection. The general operations of the screens in a preferred embodiment are described below:

Screen selections that open another screen, adjust a set point (such as NEXT or PREV), or turn something on ONLY without the ability-to turn off show their status by always having the adjacent LED 74 on.

Screen items that display information only and can't be changed or selected have no adjacent lit LED 74. Pressing buttons to the left or right of the screen item has no effect.

Additionally, on the currently displayed screen 73, the pathname to the screen is shown in the line of text above the bottom row of buttons (screen selections).

Pressing BACK opens the previous screen and Pressing EXIT opens the main screen 51.

The following functions may be provided for a preferred embodiment for operating the lighting options in manual mode:

COLOR SET: Allows any combination of up to six or more lighting circuits, such as SAm®, SAL® and/or FIBERWORKS® lighting circuits, to be preset to specific colors.

COLOR SWIM: Allows any combination of up to six or more lighting circuits, such as SAm®, SAL®, and/or FIBERWORKS® lighting circuits, to be preset to transition through colors in sequence, giving the appearance of the colors swimming across the water. The delay in sequencing each light can be adjusted to make the colors swim at different speeds.

As can be seen in FIG. 5A, a circuit functions screen 57 can be provided for assigning circuit functions. The circuit functions screen 57 lets users assign special logic to the circuits. For example, when setting up an automatic pool cleaner pump, a user would assign the circuit function MASTER CLEANER. With this "Cleaner" logic, the cleaner pump would not run without the filter pump being on first, and the cleaner pump would automatically shut off whenever the spa is turned on. Factory settings provide that one of the AUX circuits is already set for MASTER CLEANER.

A feature circuits screen 58 can be provided for assigning circuit names to feature circuits. Feature Circuits provide control capability for pieces of equipment which are not controlled by AUX Circuits. In general, AUX circuits are used for high voltage equipment like pumps and lights, whereas Feature Circuits are used for low voltage equipment like valve actuators. However, Feature Circuits can go beyond this definition, and be used in other creative ways.

For example, Feature Circuits may be assigned for controlling up to five valve actuators per system (an addition of a Valve Module can expand support to over 2). A Feature Circuit may be assigned as a way to turn a 2-speed Filter Pump to high speed. A Feature Circuit may also be assigned to activate a Spa Spillway effect, where in a pool/spa combination, all the pool water can be diverted to the spa and then spill back to the pool.

A valve actuators screen 59 can be provided for configuring valve actuators to be controlled by AUX or Feature Circuits. The IntelliTouch™ system can drive two (or more) auxiliary valve actuators for applications such as solar heating and water features. With the addition of a Valve Module circuit board, installed in the load center, the system can accommodate up to three (or more) additional actuators. It Is preferable to first assign names to the AUX or FEATURE circuits before configuring the valve actuators. That way, when the user arrives at step 2 of this process, the user can easily find the control circuit he wishes to match up to each particular valve actuator.

Auxiliary valve actuators can be controlled by any AUX circuit or a FEATURE circuit. If the models do not include any FEATURE circuits, the AUX circuits can be used for controlling valve actuators. By using FEATURE circuits to control valve actuators, the user can conserve the AUX circuits for high voltage relays for controlling pumps and lights, for example.

Additional programming functions can also be provided for the users convenience and overall integration of the pool environment with the apparatus.

The invention has been described hereinabove using specific examples; however, it will be understood by those skilled in the art that various alternatives may be used and equivalents may be substituted for elements or steps described herein, without deviating from the scope of the invention. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. A method of creating dynamic color displays in a pool, comprising the steps of:

providing a first lighting fixture positioned at a first location in the pool, the first lighting fixture configured to be controlled by time domain switching;

providing a second light fixture positioned at a second location in the pool, the second location being a distance from the first location, the second lighting fixture configured to be controlled by time domain switching;

signaling one of the first lighting fixture and the second lighting fixture to begin color changing; and signaling the other of the first lighting fixture and the second lighting fixture to begin color changing after a time delay has elapsed from the signaling of the one.

2. The method of claim 1, wherein said time delay is adjustable.

3. The method of claim 2, further comprising the step of adjusting said time delay.

4. The method of claim 1, wherein said signaling steps are performed by a lighting system controller that includes a processor.

5. The method of claim 4, wherein said lighting system controller is configurable for single-pushbutton control of said dynamic color displays.

6. The method of claim 1, further comprising the step of controlling the dynamic color display through actuation of a single pushbutton.

7. The method of claim 1, further comprising the steps of: initiating the dynamic color display through actuation of a single pushbutton; and stopping the dynamic color display through actuation of said single pushbutton or another pushbutton.

8. A lighting system controller that creates dynamic color displays in a pool, the controller comprising:

a first switch connected to a first lighting fixture positioned at a first location in the pool, the first lighting fixture configured to be controlled by time domain switching;

a second switch connected to a second lighting fixture positioned at a second location in the pool, the second location being a distance from the first location, the second lighting fixture configured to be controlled by time domain switching; and a processor independently controlling said first switch and said second switch for providing time domain switching to both said first lighting fixture and said second lighting fixture, wherein said controller is configurable for first signaling said first lighting fixture to begin color changing and then for second signaling said second lighting fixture to begin color changing after a time delay has elapsed after said first signaling.

9. The controller of claim 8, wherein said time delay is adjustable by a user.

10. The controller of claim 8, further comprising a plurality of output switches for switching power to a plurality of controlled devices that are not lighting fixtures, and wherein said processor is capable of actuating said plurality of output switches.

* * * * *